US007574325B2

(12) United States Patent
Dykstra

(10) Patent No.: US 7,574,325 B2
(45) **Date of Patent: *Aug. 11, 2009**

(54) METHODS TO MONITOR SYSTEM SENSOR AND ACTUATOR HEALTH AND PERFORMANCE

(75) Inventor: Jason D. Dykstra, Addison, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 28 days.

This patent is subject to a terminal disclaimer.

(21) Appl. No.: 11/700,735

(22) Filed: Jan. 31, 2007

(65) Prior Publication Data

US 2008/0183415 A1 Jul. 31, 2008

(51) Int. Cl.
*G06F 19/00* (2006.01)

(52) U.S. Cl. ..... 702/186; 702/85; 702/6; 73/152.02; 166/250.01

(58) Field of Classification Search ..... 702/186, 702/127, 85, 6; 73/861.356, 152.02; 166/250.01
See application file for complete search history.

(56) References Cited

U.S. PATENT DOCUMENTS 6,046,685 A 4/2000 Tubel
6,260,004 B1 7/2001 Hays et al.
6,505,519 B2 * 1/2003 Henry et al. ..... 73/861.356
7,020,701 B1 * 3/2006 Gelvin et al. ..... 709/224
2002/0148644 A1 10/2002 Schultz et al.
2003/0028345 A1 * 2/2003 Watkins et al. ..... 702/130
2004/0088115 A1 5/2004 Guggari et al.

FOREIGN PATENT DOCUMENTS

EP 0 315 391 A2 5/1989
EP 1 227 215 A2 7/2002
GB 2 226 633 A 7/1990
WO WO 2004/005661 A2 1/2004

OTHER PUBLICATIONS

Foreign communication related to a counterpart application dated Jul. 16, 2008.

* cited by examiner

*Primary Examiner*—Drew A Dunn
*Assistant Examiner*—Hien X Vo
(74) *Attorney, Agent, or Firm*—John W. Wustenberg; Groover & Associates

(57) ABSTRACT

A method for assessing health and performance of a system. In one example, the system comprises subsystems (preferably physically coupled subsystems), at least some of which are characterizable by transmitted signals. Some of these signals are transformed into a comparable form and compared, so as to identify signals that are outside of operating bounds.

22 Claims, 6 Drawing Sheets

METHODS TO MONITOR SYSTEM SENSOR AND ACTUATOR HEALTH AND PERFORMANCE

BACKGROUND AND SUMMARY OF THE INVENTION

The following applications filed concurrently herewith are not necessarily related to the present application, but are incorporated by reference herein in their entirety: "Methods for Managing Flow Control Valves in Process Systems" (U.S. patent application Ser. No. 11/700,397, filed simultaneously with the effective filing date of the present application, "Systems for Managing Flow Control Valves in Process Systems" (U.S. patent application Ser. No. 11/700,533, filed simultaneously with the effective filing date of the present application, and "Systems for Monitoring Sensor and Actuator Health and Performance" (U.S. patent application Ser. No. 11/700,396, filed simultaneously with the effective filing date of the present application.

DESCRIPTION OF BACKGROUND ART

Modern oilfield rigs use automated equipment in many aspects of an operation. A key element of such complex systems is the control and monitoring system. These systems include sensors and other elements that signal a control unit in a feedback loop. The control unit monitors the system, providing stability and ensuring the system operates within desired parameters.

Sensors are often placed at specific locations within a system to provide information necessary for the control unit to function. For example, on a drill rig, mud must be provided within specific parameters. Sensors monitor the flow rate of the mud, pressure, density, and other measurables, and this information is fed back to the control unit and/or to an operator who manually monitors the system for failures.

Current systems normally rely on operators to take action when failure occurs. These failures can affect job performance and lead to job failure. Also, the operators receive minimal feedback from the control system about its current operating state relative to its expected state. This means an operator is liable to be unaware of impending or immediate failures, and requires a higher degree of knowledge on the part of an operator. The lack of diagnostic systems to monitor performance and an interface designed to give an operator assistance means that operators are required to have a higher level of skill and knowledge to safely and efficiently monitor and operate these systems.

Methods to Monitor System Sensor and Actuator Health and Performance

In one example embodiment, the present innovations provide a method to monitor for failures in one or more subsystems (preferably physically coupled subsystems) in a larger system, and (in some embodiments) update the operator of failures or impending failures to improve process control. It also can include a system with process control knowledge to help operation of the equipment and reduce operator error.

In one class of preferred embodiments, the innovations include a plurality of subsystems (such as sensors or actuators, or combinations of parts) that can signal operation or state information. This information is used to determine if one or more subsystems are in or near failure mode.

For example, in one example implementation, a sensor of interest is selected, such as a flow rate sensor. Other subsystems of the total system that are physically coupled to the flow rate sensor provide information that is transformed into data that is comparable to the output of the flow rate sensor. This information is compared, and discrepancies indicate that some sensor of the system may be failing or outside preferred operating conditions. Operating conditions or bounds can be chosen or generated in a number of ways, including static, dynamic, or operationally dependent bounds. Bounds may be also be reevaluated in real time, in dependence, for example, on system dynamics.

In another example implementation, subsystem signals are aggregated and transformed into comparable form so that discrepancies can be identified. Thus, for example, multiple physically coupled subsystems form a redundant check on one another so as to monitor each individual subsystem's health and performance.

In preferred embodiments, actual subsystem (e.g., sensor or actuator) readings are compared to a model of the system dynamics, so actual subsystem operation can be compared to expected subsystem operation.

By using the available sensor data in conjunction with a model of the system dynamics, the controller can be designed to estimate sensor and actuator failures and update the operator through the interface. The controller can also be designed with system intelligence which can be used to help the operator perform the job and reduce operator error.

The disclosed innovations, in various embodiments, provide one or more of at least the following advantages:

- detection of individual sensor or actuator failure or inaccuracy;
- overall system health monitoring;
- reduction of necessary operator skill and chance of operator error;
- ability to switch control modes depending on sensor or actuator health.

BRIEF DESCRIPTION OF THE DRAWINGS

The disclosed inventions will be described with reference to the accompanying drawings, which show important sample embodiments of the invention and which are incorporated in the specification hereof by reference, wherein.

DETAILED DESCRIPTION OF THE PREFERRED EMBODIMENTS

The numerous innovative teachings of the present application will be described with particular reference to the presently preferred embodiment (by way of example, and not of limitation).

Figure 1:
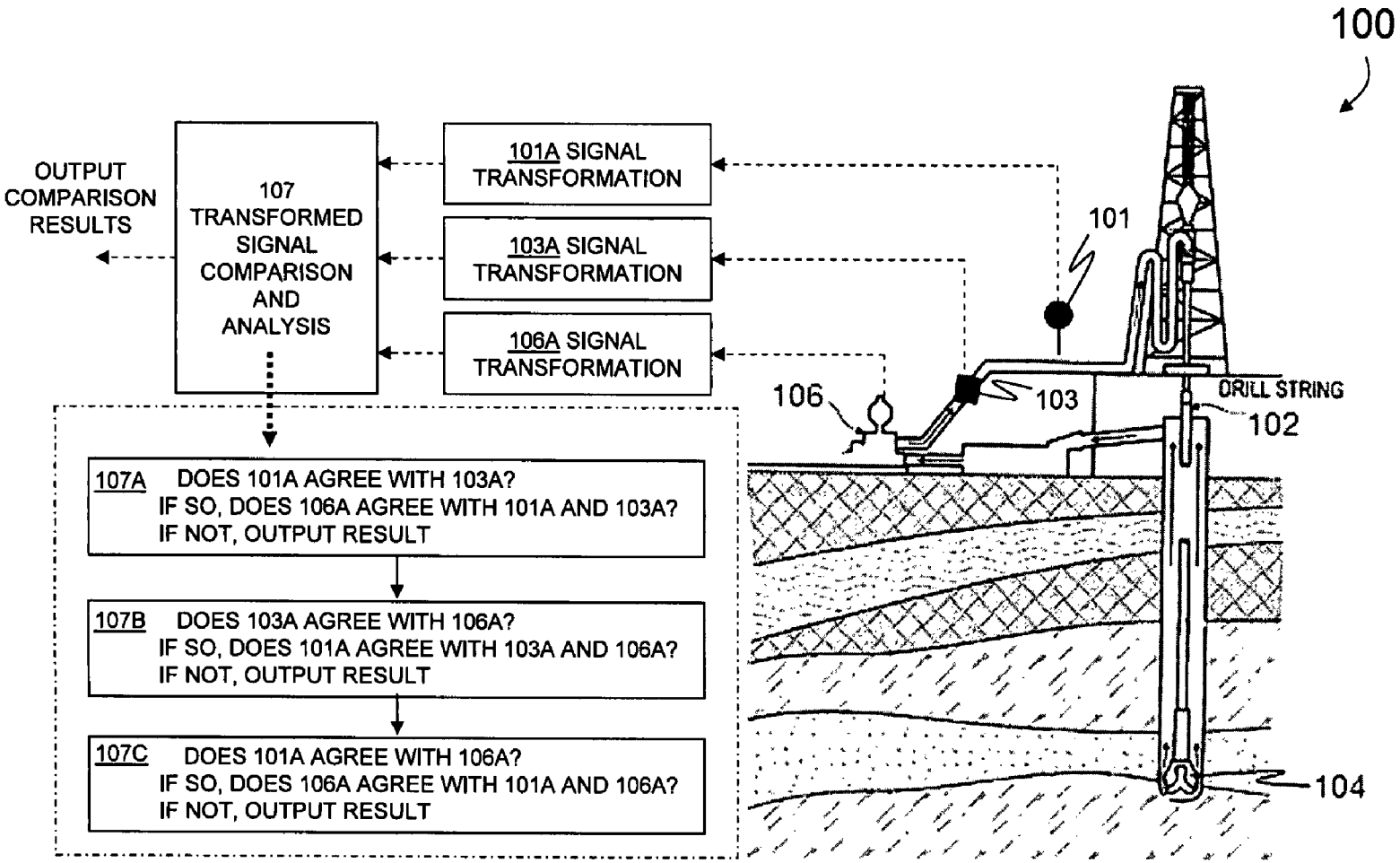
FIG. 1 shows one embodiment of the present innovations as implemented in an exemplary hydrocarbon well drilling rig site.

FIG. 1 shows an example system in which embodiments of the present innovations can be implemented. This example shows an oilfield drilling system 100, including a drill string 102, and downhole tool 104. Drilling system 100 also includes a pump system 106 which controls insertion of materials downhole, such as drilling mud for cooling and removal of debris, or other slurries (such as sand and water combinations) for various tasks.

In a preferred embodiment, the drilling system 100 includes sensors such as flow meter 101 that monitor and characterize the performance of various subsystems. This information is used, often by an operator, but also by automated systems, to determine when performance is outside desired bounds or failure occurs or is about to occur.

Specifically, FIG. 1 also shows one embodiment of the present innovations as an oilfield equipment system 100 which can be comprised of a pump system 106, a rotary flow control valve with an actuator/position indicator assembly as 103, a flow meter 101, a drill string 102, a drill bit down hole at 104, and a plurality of signal operations, computations, and other actions that can be configured with a general purpose computer (not shown) that is monitoring system 100. Pump 106 can pump a drilling fluid through control valve 103 and through flow meter 101, then down drill string 102 through bit 104 and then can re-circulate the fluid back to itself. Thus, the pump, the valve, and the meter are physically coupled by the drilling fluid. Pump 106 can send a pump speed signal to stage 106A for transformation of the speed signal to a volumetric fluid flow rate, in say, gallons per minute ("GPM"). Flow meter 101 can send a flow rate signal to stage 101A for transformation to a volumetric fluid flow rate in GPM. Valve 103 position indicator can send a signal to stage 103A for transformation of the "% OPEN" signal of the valve to a volumetric flow rate in GPM. Stage 107 can compare the three transformed signals for agreement in stages 107A, 107B, and 107C. If one signal is found to disagree with the other two signals, an output signal can be made to notify an operator that the particular component that is not in agreement needs maintenance or attention. Further, the output signal can be used to effect an automatic reconfiguration of the control system operating the overall system 100 to thereby exclude the disagreeing signal from the control methods being used to operate the system.

Figure 2:
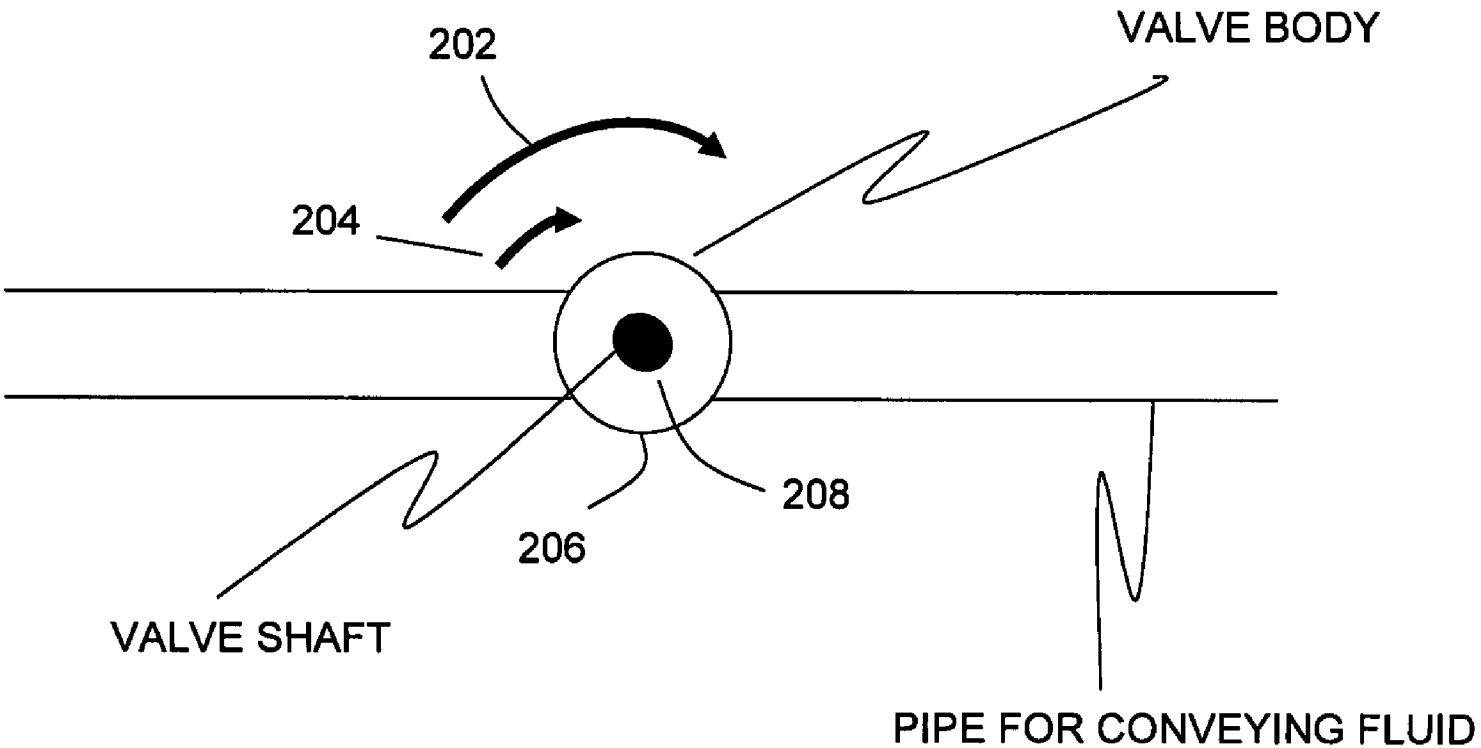
FIG. 2 shows an example of actuator slippage.

For an example of a rotary-actuated valve, FIG. 2 shows a top view of an example rotary-actuated valve 206 that is operated by an actuator attached to the valve shaft 208, which opens and closes the valve by rotating the valve shaft according to a signal. In some situations, such as when a valve is stuck, aged, or otherwise not operating correctly, there can be a difference between the signaled valve movement 202 and the actual valve movement 204. In the example of FIG. 2, the actuator was signaled to move the valve a first amount 202, while the actual valve movement 204 was less. For example, the difference in movement can represent a difference in the signaled angle of rotation. In other instances, a valve can be vertically actuated and the difference can represent the error in valve stroke. In some situations, reports of valve movement can depend on signaled movement 202 and not actual movement 204. Especially in complex systems, failure to obtain accurate information about actual subsystem performance (such as the movement of the valve) can harm production and propagate to other parts of the system.

In one example embodiment of the present innovations, subsystems of a larger system (preferably physically coupled subsystems, or subsystems that can otherwise be characterized in terms of one another) are redundantly monitored. For example, subsystems that affect a sensor or actuator (in preferred embodiments) are compared in order to characterize a given sensor or actuator's current, actual level of performance in order to determine if the sensor or actuator is performing within accepted bounds.

Inputs and outputs that affect (or are affected by) the subsystem are, in preferred embodiments, transformed into comparable sensor or actuator states to monitor sensor or actuator performance. For example, when a given system includes several sensors that monitor physically coupled subsystems, some or all the sensors outputs can be transformed into the same units or data as one of the sensors, to determine if that sensor is sending accurate signals of the subsystem which it monitors. By transforming these signals into a single, comparable set of data, the present innovations provide a way to redundantly check each individual sensor of the group of sensors. This redundant checking can be performed in a number of ways, such as by selecting a sensor of interest and transforming all other sensor data into data that is comparable to the sensor of interest, or by transforming all sensor data into a single form so their signals can be aggregated and compared, for example, by checking standard deviations between signals, spread, and other statistical analysis.

For example, a sensor or actuator of interest can be viewed as being coupled (such as physically coupled) to other actuators and sensors if the signal or operation of one is affected by, or affects, the other actuators or sensors. Transformation of the various signals is derived from physical system dynamics. The transformed signals of multiple coupled subsystems effectively become redundant sensors.

In preferred embodiments, subsystem performance, as determined by one or more of the redundant sensors, is compared to predetermined or dynamic bounds to determine if the subsystem is performing properly, for example, or close to or in failure. These bounds can be static or operationally dependent, and/or reevaluated in real time. Other performance constraints can be created from the dynamic limits of the physical system. The physical system operational envelop can be defined, for example, as a state vector of first order derivatives (i.e., change over time) which can be used to define acceptable operational ranges of the sensors. Such a mechanism can be used to detect, for example, when a sensor registers severe change, which can indicate either a subsystem in failure, or sensor malfunction. Operational bounds or envelopes can also be dynamically reset, for example, relative to physical system dynamics.

Further embodiments of the present innovations include interfaces wherein results of one or more of the redundant sensors are reported to an operator, preferably coupled with information to help the operator or give assistance in detecting, for example, when corrective action needs to be taken and reduce operator error.

In many complex systems, such as those described below, sensor information is used in feedback loops to aid in controlling systems to provide stability and to ensure that a system operates within acceptable limits or bounds. When data from a plurality of sensors are used by a control unit in a feedback and control system, the present innovations allow for more robust control in several ways. For example, in one example embodiment, if a plurality of sensors are used to inform a control unit, and if one of those sensors goes out of operational bounds, that sensor's signal can be removed from input to the control unit. In preferred embodiments, the control algorithm used in the control system can be modified to operate without the data from the sensor that was removed. In other embodiments, a sensor can experience temporary periods when its signal is outside of operational bounds, indicating bad sensor data, for example. In such cases, the sensor can be temporarily removed from input to the control unit, and later, when it has resumed operation that is within operational bounds, its signal can be reintroduced to the control unit.

The present innovations are discussed with reference to an example system, such as that depicted in FIG. 3. In this case, a sand and liquid blending system 300 that includes a sand supply 302, a liquid supply 304, a blender 306, and a pump system 308. In this example, because of such physical realities as fluid dynamics, various parts of the system are physically coupled. For example, the input and output of the blender are dependent on one another, in that changes in one are affected by, affect, or can otherwise be detected in changes in the other. For example, measured rate of flow into the blender would be coupled with measured rate of flow out of the blender. These two quantities could therefore be expressed as functions of one another. More detailed examples follow.

Figure 3:
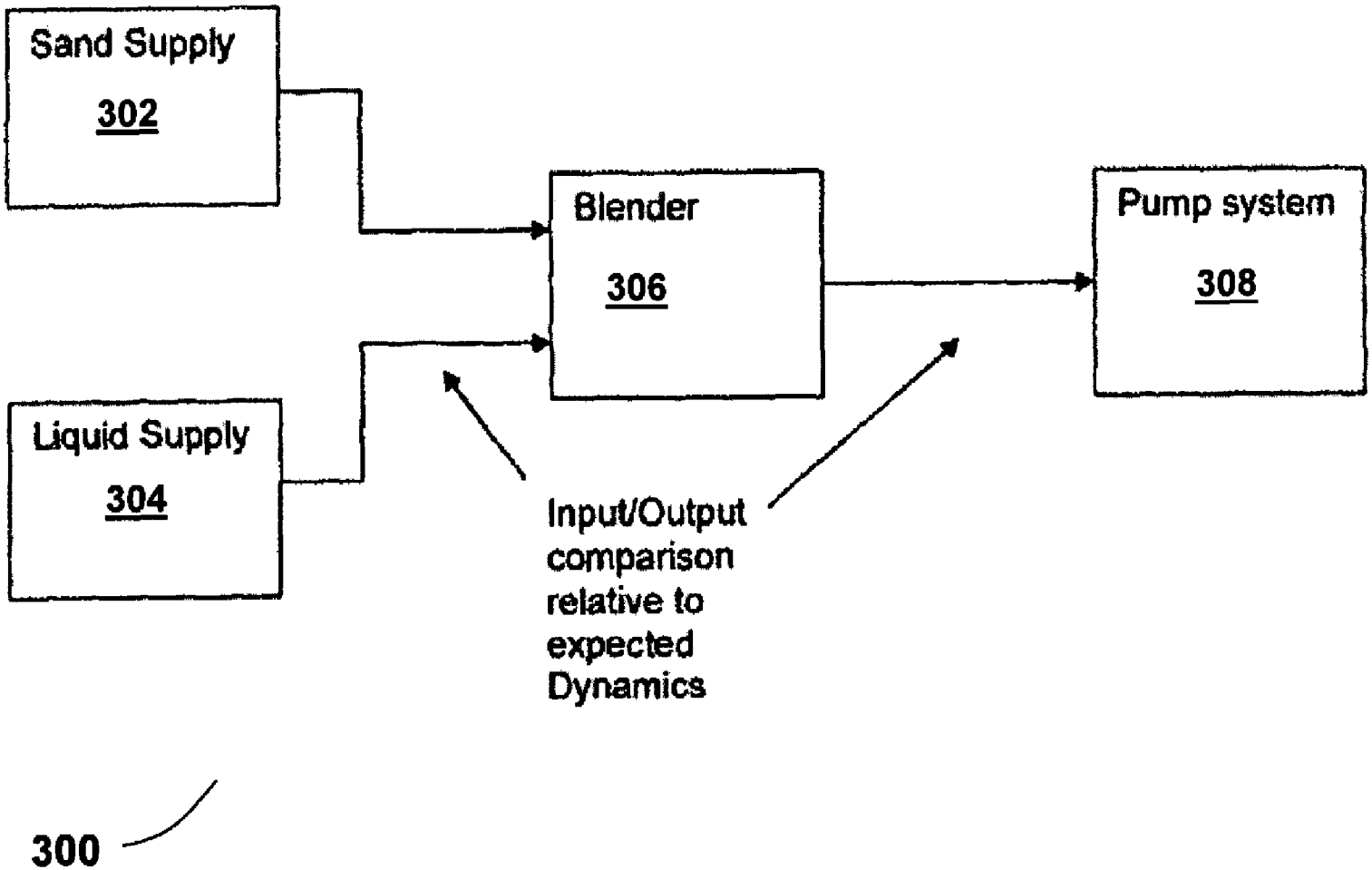
FIG. 3 shows a sand and liquid slurry system consistent with implementing an embodiment of the present innovations.
Figure 4:
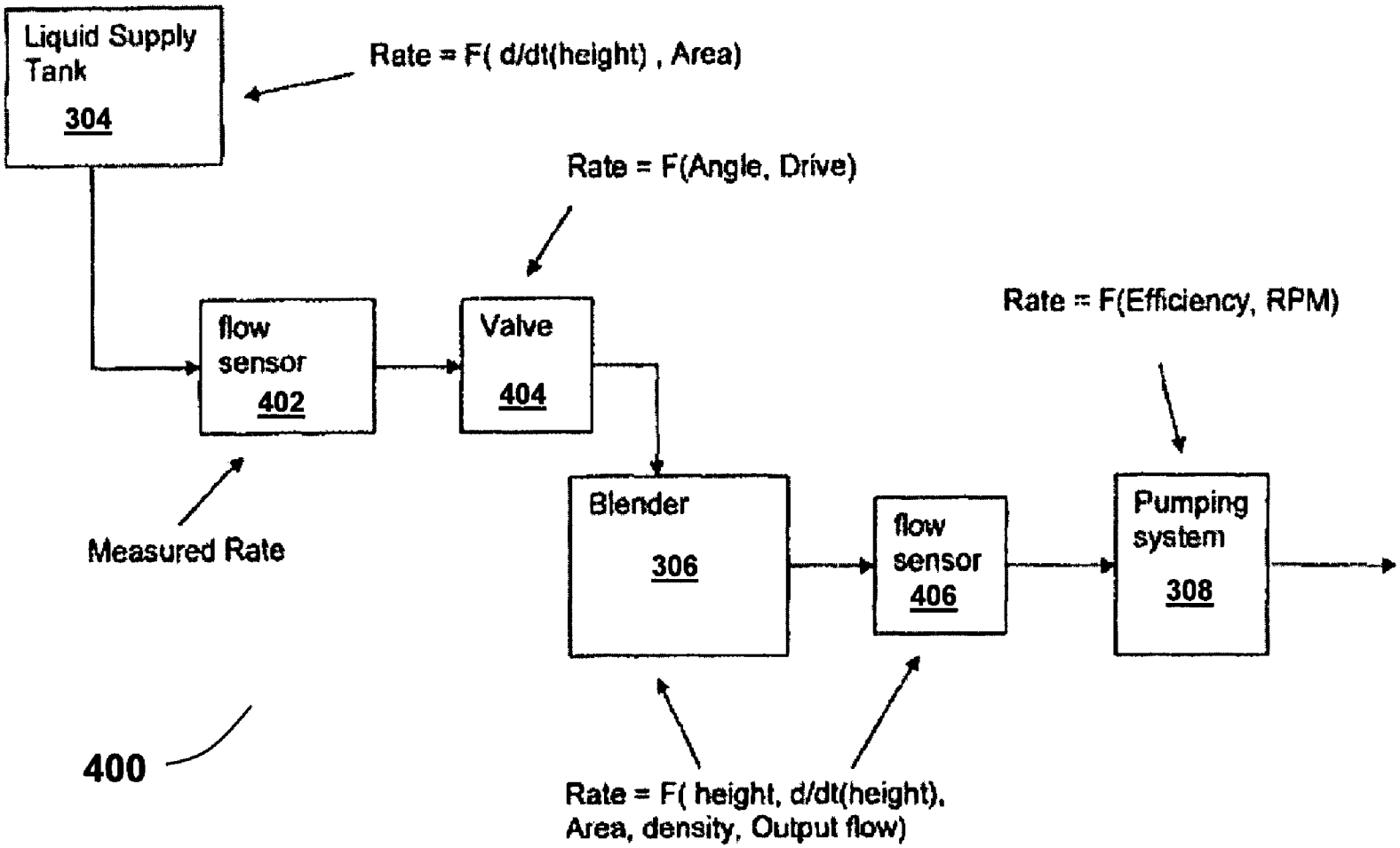
FIG. 4 shows a detail of the liquid supply side of the sand and liquid slurry system consistent with implementing an embodiment of the present innovations.

FIG. 4 shows a detailed view of the liquid supply subsystem 400 of the system shown generally in FIG. 3. Liquid supply tank 304 sends liquid to blender 306 which outputs to a pump system 308. Output from liquid supply tank 304 is monitored by a flow sensor 402 and is controlled by a valve 404. Downstream of blender 306, another flow sensor 406 monitors output to the pumping system 308.

Because, in this example, all these elements are physically coupled (via the flow stream hydraulics, in this example), they can be characterized in terms of one another. For example, flow sensor 402 directly measures the liquid flow rate. However, changes in the height of the liquid supply tank 304 over time and the area of the tank can provide an expression that also provides a determination of flow rate that is comparable to, or should agree with, that directly measured by sensor 402. Likewise, valve 404 can be used to express rate as a function of the valve flow constant, the valve-open angle and drive signal applied to the valve 404. The blender 306 and flow sensor 406 can, together, provide rate as a function of the height, the change in height over time, the area, density, and output flow of the blender. Finally, rate can be expressed at the pumping system 308 in terms of the efficiency, output curve, and RPMs of the pumping system.

These multiple functions that result in flow rate determinations effectively form a system or plurality of redundant sensor measurements for flow rate measurements (in this example). In one embodiment of the present innovations, these values are compared to the sensor 402 to determine if the sensor 402 is operating correctly. For example, if the subsystems that also indirectly measure the flow rate yield a relatively consistent flow rate, and if sensor 402 differs significantly from this rate, then the accuracy of sensor 402 is called into question. In other embodiments, all five of these subsystems (including sensor 402) can be aggregated and statistically analyzed, for example, by measuring their standard deviation, and/or identifying any individual subsystem that differs from the other readings beyond a predetermined threshold or envelope. Other statistical manipulation or analysis of these data is also possible.

Thus, the various data of the subsystems can be dynamically transformed into an interested subsystem's performance.

The disclosed sensor checking and dynamic characterization system can be used in other ways as well. For example, in one embodiment, if a sensor is found to operate outside of predetermined (or dynamic, or operationally dependent) bounds, that sensor can be removed. In other embodiments, the sensor can be temporarily removed, and reintroduced when its operation returns within desired limits. Changes in the sensor operation over time, as detected by the present innovations, can also exceed limits as described above. In other embodiments, a sensor or subsystem might go out of operational bounds and be removed from input to the control algorithm that maintains stability in the system. In some embodiments, the sensor's input is simply removed, and may or may not be reintroduced when the sensor is once again found to be operating within desired limits.

In other embodiments, the sensor's input is removed (temporarily or permanently) and, additionally, the control algorithm is modified to account for the reduced input information. For example, some cement mixing systems can be designed to switch from being controlled using density information (i.e., information from density sensors/calculations) to being controlled using volume information i.e., information from volume sensors/calculations). In such an example system, if the density sensor is determined to be in a failing mode and is removed from the input to the control algorithm, then the system can switch from density mode to volumetric mode, and thereafter the control algorithm would be modified to accept and use information gathered from the sensors associated with the volumetric mode. Other examples also apply, such, such as when a height sensor fails, the innovative system can switch to density mode and use the changed input in its control algorithm. In these example cases, in preferred embodiments, an operator would be informed and may have to take necessary actions, such as controlling some levels manually.

Figure 5:
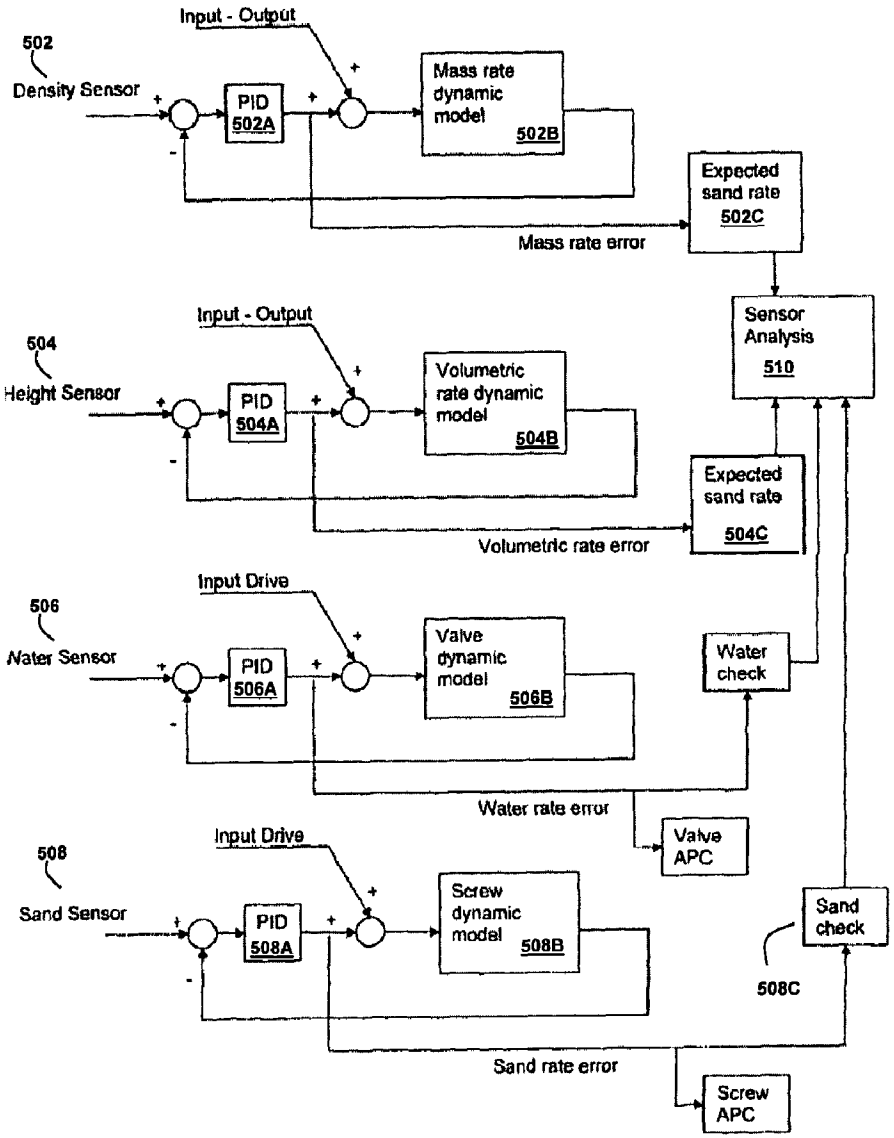
FIG. 5 shows a control diagram of a blender unit consistent with an embodiment of the present innovations.

FIG. 5 shows a further detail of the blending system 306 shown in FIG. 3, showing the control loops that maintain stability in the respective systems. A density sensor 502, a height sensor 504, a water sensor 506, and a sand sensor 508 are shown in context of a control system diagram. Each control loop includes a control unit or algorithm, represented by PID (proportional, derivative, integral) controller (shown variously as units 502A-508A) that is associated with elements in the forward path, between the error signal and the control signal. (Other types of control models can of course be implemented, and the present example is illustrative only.) The depicted system includes signals that represent the error between the dynamic models (502B-508B) and the outputs of their respective sensors. Each sensor measures some property that is also being dynamically modeled. The input to the dynamic models from the PIDs (in this example) are the amounts needed to correct the dynamic models so they match their respective sensor readings. Each control loop also has a dynamic model (502B-508B) of the system or subsystem on which the control unit imposes stability.

As mentioned above, the other inputs and outputs can be dynamically transformed into an interested system's performance. In this example, there are three ways to determine expected sand rate. The mass rate error signal can be dynamically transformed (in the same way that readings were transformed into liquid flow rates, above) to achieve an expected sand rate 502C. Likewise, the volumetric rate error signal can be transformed into an expected sand rate 504C. And the sand screw dynamic model gives a measure of the sand rate by taking into account the drive signal, the speed of the screw, and other known dynamics.

It should also be noted that this system contains an adaptive parametric control (APC) to map nonlinearities. This concept can be applied in several ways, such as examining actuator, valve, or other system performance and identifying problems.

For example, in one embodiment, the APC is used in examining actuator performance and looking for problems.

There are several ways this innovative concept can be implemented, and some examples follow. These examples are intended to describe embodiments, and not to limit the application of the innovative concepts.

In general terms, these innovative concepts include, in a first embodiment, modeling of the dynamics of a system as expected in normal operation; modeling the dynamics of the system in real time; and comparing the two models to determine if a failure has occurred. In another embodiment, the present innovations include embodiments that use a learning algorithm to determine a parameter in a model of the dynamics; and using that parameter to detect system failure, such as by monitoring that parameter (or systems from which that parameter can be derived) during operation.

In a first example, a model of failure behavior is generated. The model of system failure is compared to the system as the system is running. This comparison can provide additional information, about both the failure model and the system dynamics. For example, the dynamics of valve slop (or mismatch between a valve control signal and actual valve performance) may be well known. The model of valve slop can be compared to the system dynamics while the system is running. For example, the deadband of the valve and the valve coefficient (or an aspect of the control signal) can be mapped so as to increase the accuracy of the valve slop model. This will provide information about the wear that is occurring and the flow characteristics through the valve.

In another example, the dynamics of the system are mapped while the system is running, but without a model of how the system fails or misbehaves. In this case, the mapped dynamics are compared to a threshold value, such as one or more dynamic performance specifications, to see if the mapped system dynamics are within bounds. For example, a pump's performance can be modeled under normal operating conditions. The parameters of that model can be dynamically compared to actual performance while the system is running. The system under normal operating conditions should produce a torque feedback doe to damping that is a function of speed. If the mapped damping coefficient becomes large, and outside the specs, a problem may have occurred, such as the pump experiencing environmental loading. This could be, for example, a sign that the piston chamber is filled with sand. The number of sensors and observable states would determine how many properties could be mapped to the dynamic model or thresholds.

In another example, a learning algorithm (such as a neural network) determines normal operating behavior. The model created by the learning algorithm can be compared to sensor data to determine how well the system is tracking "normal" behavior, and to thereby detect failures.

These subsystems effectively serve as virtual sensors, and their outputs are input to a sensor analysis program 510, such as a computer program product on a computer readable medium that analyzes the readings, as described above. For example, the sensor readings can be monitored for behavior so as to indicate (for example, by a signal to an operator or by automated alarm or controls) when a given sensor is operating outside predetermined bounds (whether dynamic or static).

Figure 6:
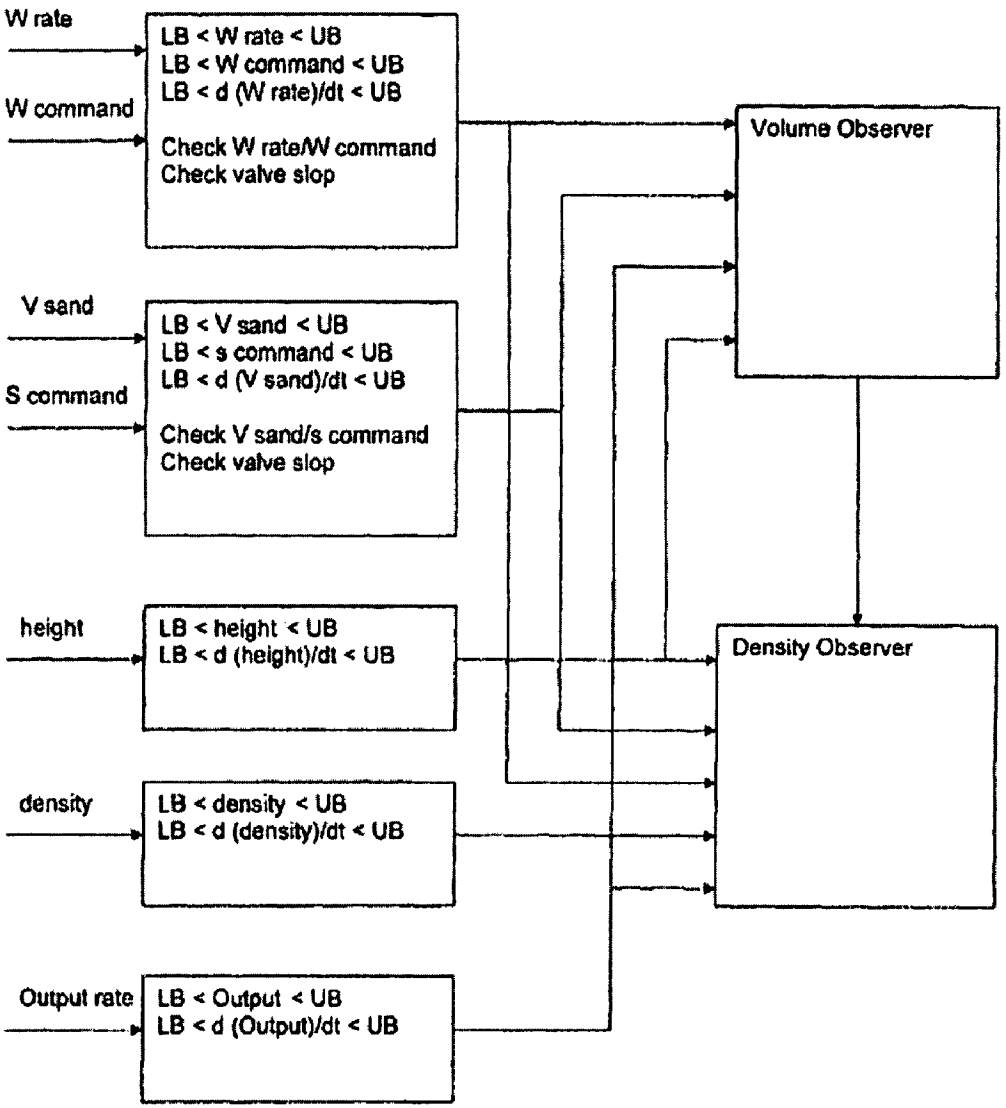
FIG. 6 shows an example implementation of redundant sensor checking relative to dynamic links of a physical system, consistent with an embodiment of the present innovations.

FIG. 6 shows sensor checking relative to dynamic limits to the physical system. Here, the known operational envelop, shown as lower bound (LB) and upper bound (UB) are used to check the sensor and actuator performance relative to the current operating position and derivative of that position. The current will determine the allowable sensor envelope. As an example, if a mixing tub is being filled with gel and sand, and that mixture is leaving the mixing tub at some rate, then the rate of change of the tub level sensor should output a signal value that is close to what would be expected for that rate of change of volume.

FIG. 6 includes a plurality of levels of checking. For example, the water rate includes three separate levels of performance checks. In a first case, the water rate is directly measured, for example, by a flow meter or other means of checking movement of the water. Lower bounds and upper bounds are set for the water rate, and if the water rate exceeds these bounds, a signal indicating unacceptable behavior or performance can be sent. A second condition for bounding the water rate is based on the commands sent to the actuator that controls the water rate. Known changes in the actuator correspond to known changes in the water rate. If a given command is sent, and yet the water rate does not respond as expected (within bounds), then a signal indicating this behavior can be sent. Finally, the change in the water rate can be used to set bounds on the water rate. In this case, the dynamic behavior of the water rate can, for example, have known bounds outside which unacceptable behavior is indicated. For example, if it is known that the change in water rate should not exceed d(water rate)/dt, and if checks on the water rate indicate that the dynamic behavior of the water rate exceeds preset bounds, then a signal indicating such condition can be sent.

All these bounds or indications of the water rate can be used, for example, as checks on the water rate. In some cases, the water rate, or the water actuator command, or the dynamic changes in the water rate, may be inferred from data from other (coupled) systems. In such cases, the data from the coupled systems is preferably transformed into one of the three example measures for acceptable water rate behavior, and compared to the predetermined bounds.

As seen from the examples, the present innovations include, in at least one embodiment, a multi-layered solution in which all the sensors and actuators are combined with system intelligence to determine failure, or likelihood of failure. (For example, bounds can indicate failure, or conditions that are known or suspected to lead to failure.) This provides an improved view of system health and performance, and also permits signaling to operators so that failures are prevented or caught more quickly, reducing operator error.

According to a disclosed class of innovative embodiments, there is provided a method of monitoring an oilfield equipment system, comprising the steps of identifying a physical coupling among three or more oilfield equipment subsystems, monitoring a plurality of signals, each signal being associated with one of the three or more oilfield equipment subsystems, transforming one or more of the oilfield equipment subsystem signals into units associated with the type of physical coupling among the three or more oilfield equipment subsystems, comparing at least some of the signals, and indicating at least one oilfield equipment subsystem's signal that does not agree with at least two other oilfield equipment subsystems' signals.

According to a disclosed class of innovative embodiments, there is provided a method of operating an oilfield equipment system, comprising the steps of controlling system operation using readings from multiple subsystems of the system, checking the respective readings of said multiple subsystems against each other to determine whether any subsystems have readings which are physically inconsistent with each other, and under at least some conditions, changing the controlling step to exclude the output of a respective subsystem which has been determined, in the checking step, to be showing inconsistent output.

According to a disclosed class of innovative embodiments, there is provided a method for operating a system, comprising the steps of in a first procedure, monitoring a first sensor, and generating a first estimate of at least one parameter thereby; in a second procedure, monitoring a second sensor, and generating a second estimate of said parameter thereby; and comparing said first and second estimates to thereby selectively generate communications indicating undesired mismatch between said estimates.

According to a disclosed class of innovative embodiments, there is provided a method of controlling a complex system, comprising the steps of monitoring signals associated with a plurality of nodes in the system, identifying a node from the plurality whose respective signal is outside an operation limit, and switching from a first mode of operation to a second mode of operation in dependence on which node of the plurality has been identified as having a signal outside the operational limit.

According to a disclosed class of innovative embodiments, there is provided a method of monitoring an oilfield equipment system, comprising the steps of monitoring three or more signals at respective physical interfaces to at least one oilfield equipment subsystem, said signals being associated with physical states which are physically coupled but not identical, transforming one or more of said signals into a set of units associated with the type of physical coupling between the three or more signals, and indicating any oilfield equipment subsystem signal which is physically inconsistent with others of said signals.

MODIFICATIONS AND VARIATIONS

As will be recognized by those skilled in the art, the innovative concepts described in the present application can be modified and varied over a tremendous range of applications, and accordingly the scope of patented subject matter is not limited by any of the specific exemplary teachings given.

For example, the disclosed innovations can be applied in a number of areas outside the oil industry, though the preferred context is the oil industry.

For another example, though many of the examples used to describe the present innovations use specific components, such as sensors and/or actuators, the present innovations can be applied using other components as well. For example, any detection and signaling apparatus that receives information about a system and that can in any way convey that information could be implemented into the present innovations. The parameters that are monitored can also vary widely, including density, flow, volume, various derivatives, mass transfer, temperature, pressure, and any other characterizable parameter.

For another example, though the present innovations are described in the context of a sand and liquid slurry, this is only an example context. Other contexts would also benefit from the present innovations, where preferably physically coupled subsystems can be characterized in a common way.

In another example, the present innovations are only one part of a multi-level filtering system, that can include other checks on system behavior.

In other examples, the systems being monitored are characterized as being "physically coupled," or "coupled." Any transfer of information, matter and/or energy between two systems is included in the definition of "coupled" as that term is used in this application. Further, any two systems that can be characterized in terms of one another, are also considered to be "coupled" within the context of this application.

In another example, the current innovations are characterized in the context of oilfield equipment. Such equipment includes a variety of oilfield supply systems, downhole tools, above-ground equipment, such as valves, screws, pumps, agitators, and other tools associated with oilfield operations.

In another example, the signals associated with the oilfield equipment subsystems are described as being transformed into "units" associated with the physical coupling that exists among the subsystems. These units are understood to include not only physical units (such as mass, volume, rates, or other physical quantities or one or more derivatives or quantities thereof), but also "unit-less" mathematical quantities or expressions which are consistent with or associated with the physical coupling (i.e., are derivable from the type of physical coupling) in any way. For example, the units or expressions into which signals are transformed for comparison could include normalized quantities where "physical" units have been divided out of the expression. These units can also be monotonic expressions of one another, or another quantity. The units or form of the compared quantities are intended to be transformed such that they can be compared with one another, regardless of the form of the expression.

In another description of the exemplary embodiments, signals associated with the various subsystems can refer to, for example, a sensor reading, a control signal sent to a subsystem, a meter or other device that is affected by the physical coupling of the subsystem that can be monitored, or any other quantity associated with that subsystem that can be monitored in some way, and which can be expressed in terms that are comparable to at least one other subsystem that is physically coupled with the first subsystem.

None of the description in the present application should be read as implying that any particular element, step, or function is an essential element which must be included in the claim scope: THE SCOPE OF PATENTED SUBJECT MATTER IS DEFINED ONLY BY THE ALLOWED CLAIMS. Moreover, none of these claims are intended to invoke paragraph six of 35 USC section 112 unless the exact words "means for" are followed by a participle.

The claims as filed are intended to be as comprehensive as possible, and NO subject matter is intentionally relinquished, dedicated, or abandoned.

What is claimed is:

1. A method of monitoring an oilfield equipment system, comprising the steps of:

identifying a physical coupling among three or more oilfield equipment subsystems;

monitoring a plurality of signals with a computer-based monitoring system, each signal being associated with one of the three or more oilfield equipment subsystems;

transforming one or more of the oilfield equipment subsystem signals into units associated with the type of physical coupling among the three or more oilfield equipment subsystems;

comparing at least some of the signals; and indicating at least one oilfield equipment subsystem's signal that does not agree with at least two other oilfield equipment subsystems' signals.

2. The method of claim 1, wherein the type of physical coupling is selected from the group consisting of: hydrostatic pressure, flow rate, and mass transfer.

3. The method of claim 1, further comprising the step of:

modifying a control algorithm based on an identified oilfield equipment subsystem signal.

4. The method of claim 1, further comprising the step of:

sending a signal to an operator identifying an oilfield equipment subsystem, where that subsystem's signal does not agree with at least two other oilfield equipment subsystems' signals.

5. The method of claim 1, further comprising the step of:

when the step of comparing produces a result outside acceptable bounds, sending a signal to indicate the result is outside acceptable bounds.

6. The method of claim 5, wherein the acceptable bounds are selected from the group consisting of: predetermined bounds, dynamical bounds, operationally dependent bounds, and bounds associated with dynamic constraints of a physical system.

7. The method of claim 1, wherein the units are selected from the group consisting of: physical units, normalized expressions without physical units, and monotonic transformations of physical units.

8. The method of claim 1, further comprising the step of: when the identified signal is an input to a control algorithm, replacing the identified signal's input to the control algorithm with another signal without modifying the control algorithm.

9. A method of operating an oilfield equipment system, comprising the steps of:

controlling system operation using readings for dissimilar physical parameters transformed into comparable data from multiple subsystems of the system;

checking the respective readings of said multiple subsystems against each other to determine whether any subsystems have readings which are physically inconsistent with each other; and under at least some conditions, changing the controlling step to exclude the output of a respective subsystem which has been determined, in the checking step, to be showing inconsistent output.

10. The method of claim 9, further comprising the subsequent step of:

if the checking step ceases to detect inconsistencies, then, under at least some conditions, changing the controlling step again to include the output of a respective subsystem which had been excluded.

11. The method of claim 9, further comprising the step of:

when the step of checking produces a result outside acceptable bounds, sending a signal to indicate the result is outside acceptable bounds.

12. The method of claim 11, wherein the acceptable bounds are selected from the group consisting of: predetermined bounds, dynamical bounds, operationally dependent bounds, and bounds associated with dynamic constraints of a physical system.

13. The method of claim 9, wherein if a first subsystem has been determined to be showing inconsistent output, replacing the first subsystem's signal with a second subsystem's signal as input to a control algorithm.

14. The method of claim 13, wherein the second subsystem's signal is transformed into a form comparable to the first subsystem's signal before being input into the control algorithm.

15. The method of claim 9, wherein at least one of the subsystems is selected from the group consisting of:

a sensor, an actuator, a mixer, and a pumping system.

16. A method for operating a system with a computer-based controller, comprising the steps of:

in a first procedure, monitoring a first sensor for a first physical reading, and generating a first estimate of at least one parameter thereby;

in a second procedure, monitoring a second sensor for a second physical reading, and generating a second estimate of said parameter thereby;

wherein the first physical reading and second physical reading are for differing physical conditions; and comparing said first and second estimates to thereby selectively generate communications indicating undesired mismatch between said estimates.

17. The method of claim 16, wherein the first and second sensors are monitored in real time.

18. A method of controlling a complex system computer controller, comprising the steps of:

monitoring signals associated with a plurality of nodes in the system;

identifying a node from the plurality whose respective signal is outside an operation limit; and switching from a first mode of operation to a second mode of operation in dependence on which node of the plurality has been identified as having a signal outside the operational limit.

19. The method of claim 18, wherein the step of switching modes comprises:

halting input into a control system from the identified node;

adding input into the control system from a different node; and modifying a control algorithm to be controlled by the new input.

20. The method of claim 18, further comprising the step of:

when the step of checking produces a result outside acceptable bounds, sending a signal to indicate the result is outside acceptable bounds.

21. The method of claim 20, wherein the acceptable bounds are selected from the group consisting of:

predetermined bounds, dynamical bounds, operationally dependent bounds, and bounds associated with dynamic constraints of a physical system.

22. A method of monitoring an oilfield equipment system, comprising the steps of:

monitoring with a computer system three or more signals at respective physical interfaces to at least one oilfield equipment subsystem, said signals being associated with physical states which are physically coupled but not identical;

transforming one or more of said signals into a set of units associated with the type of physical coupling between the three or more signals; and indicating any oilfield equipment subsystem signal which is physically inconsistent with others of said signals.

* * * * *